United States Patent [19]

Nakatsu et al.

[11] 4,114,131

[45] Sep. 12, 1978

[54] VARIABLE RESISTOR

[75] Inventors: Yoshiyuki Nakatsu, Osaka; Hideo Nishizawa, Nagaokakyo, both of Japan

[73] Assignee: Murata Manufacturing Co., Ltd., Nagaokakyo, Japan

[21] Appl. No.: 768,618

[22] Filed: Feb. 14, 1977

[30] Foreign Application Priority Data

Mar. 2, 1976 [JP] Japan ..... 51-22750

[51] Int. Cl.[2] ..... H01C 10/30

[52] U.S. Cl. ..... 338/162; 338/164; 338/166; 338/167; 338/170

[58] Field of Search ..... 338/162, 160, 163, 164, 338/166, 167, 170, 184, 199

[56] References Cited

U.S. PATENT DOCUMENTS

| | | | |
|---|---|---|---|
| 2,863,030 | 12/1958 | Page | 338/131 X |
| 3,890,589 | 6/1975 | Kogo et al. | 338/137 X |

FOREIGN PATENT DOCUMENTS

| | | | |
|---|---|---|---|
| 1,466,695 | 12/1966 | France | 338/131 |

*Primary Examiner*—C. L. Albritton

[57] ABSTRACT

A variable resistor for use in electrical and electronic equipment which includes a base plate, a lower stator terminal housed in a circular recess formed in one surface of the base plate, a rotor member having an electrically conductive film layer at its one surface and an electrically resistant film layer at its other surface and rotatably mounted on the lower stator terminal with the conductive film layer contacting the lower stator terminal, and an upper stator terminal fixed to the base plate so as to slidingly contact the resistant film layer under pressure.

20 Claims, 10 Drawing Figures

VARIABLE RESISTOR

Figure 1:
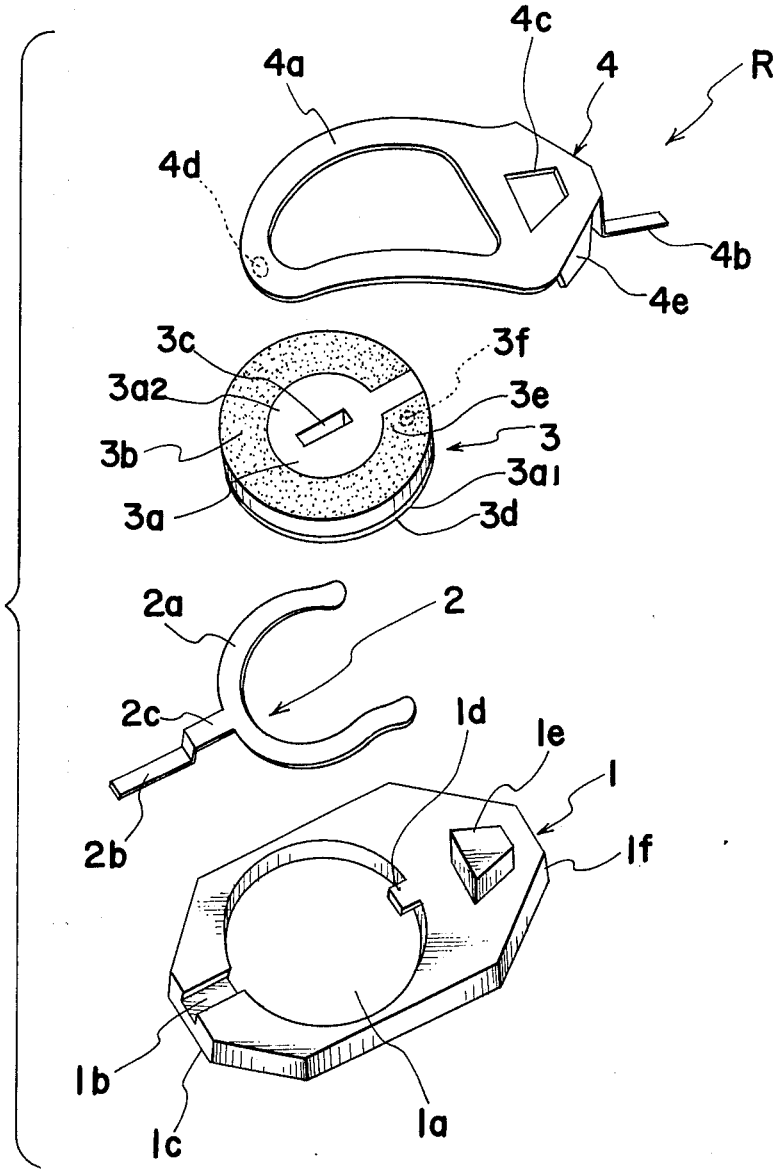

The present invention relates to an electrical resistor and more particularly, to a variable resistor for use in electrical and electronic equipment.

With the recent trend to miniaturization of circuit structures for various electrical and electronic equipment and devices, for example, electronic watches, cameras, hearing aids, transceivers and the like, there has been a great demand for variable resistors of extremely small sizes which function stably and have high reliability in various fields of electrical and electronic industries.

Conventionally, a variable resistor, for example a variable resistor of the rotary type, is so constructed that an approximately C-shaped resistant film is formed on a substrate or base plate, and a slider is adapted to slide over the resistance film for providing varying resistances.

The known variable resistor of the above described type based on the concept of moving the slider on the fixed resistance film has disadvantages such as, in the miniaturization thereof the slider is difficult to properly design for optimum performance due to its short span with consequent lack in reliability, and that a knob or groove to rotate the slider for resistance adjustments is not readily provided due the extremely small size of the variable resistor and even if it can be provided somehow, it is not easy to use, while efficiency in the manufacture of such miniaturized rotary type variable resistors is extremely low, resulting in a increased rate of unacceptable products and less product dependability due to the complicated processes involved therein such as connections by soldering or mechanical engagement, for example, between the slider and intermediate terminals or between the resistance film and fixed terminals, thus resulting in an increased cost of the variable resistors thus produced.

Accordingly, an essential object of the present invention is to provide a variable resistor, particularly one of extremely small size, which functions stably and is highly reliable despite its extremely small size.

Another important object of the present invention is to provide a variable resistor of the above described type which is easy to use and readily incorporated into various electrical and electronic equipment and devices.

A further object of the present invention is to provide a variable resistor of the above described type which has a simple construction and can be manufactured with high working efficiency at low cost, with substantial elimination of the disadvantages inherent in the conventional variable resistors of the kind.

In accomplishing these objects, in the present invention, the technical concept used in conventional variable resistors in which the slider is adapted to slidingly move over the resistance film for varying the resistance has completely been changed to an entirely fresh concept wherein a rotor member provided with a resistance film is caused to slidingly move over a stationary slider or stator terminal. More specifically, according to one preferred embodiment of the present invention, the variable resistor generally comprises a base plate of electrically insulating material, at least one lower stator terminal accommodated in a recess formed in one surface of said base plate, a rotor member having an electrically conductive film layer on its one surface and an electrically resistant film layer on its other surface, and rotatably mounted on said lower stator terminal with said conductive film layer contacting said stator terminal, and an upper stator terminal fixed to said base plate and contacting the resistant film layer of said rotor member under pressure. By the simple arrangement as described above, which requires no soldering work during assembling, a variable resistor of extremely small size which is easy to use, and yet having high reliability in performance at low cost and which can be readily incorporated into various electrical and electronic equipment and devices, particularly those of compact sizes, has advantageously been provided.

Figure 2:
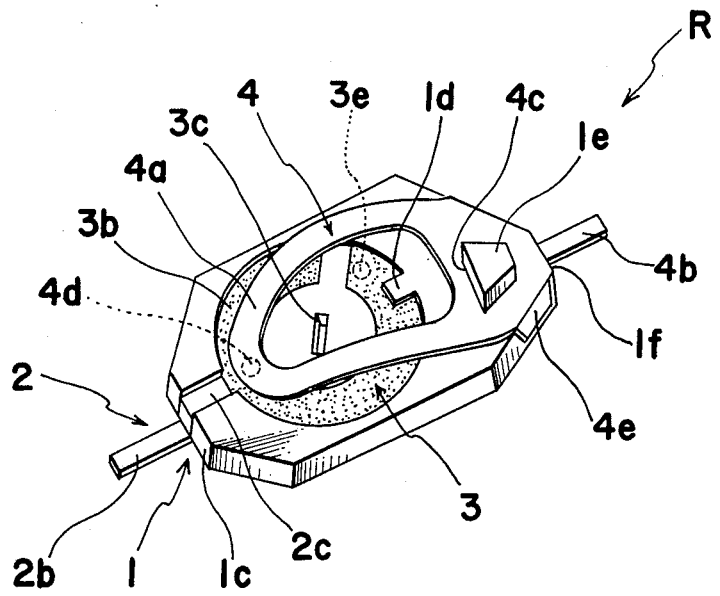
Figure 3:
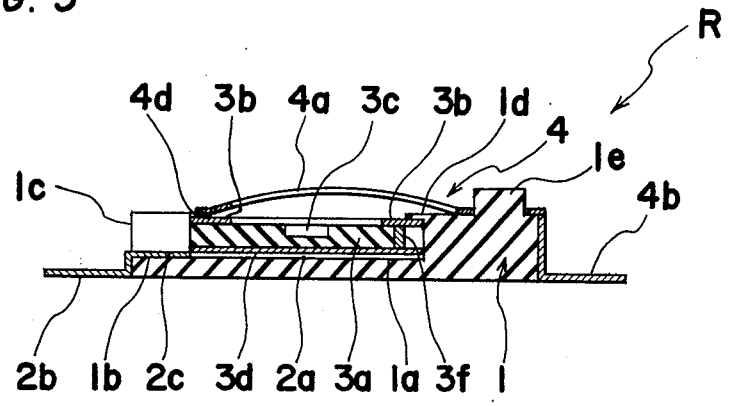
Figure 4:
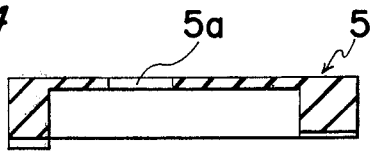
Figure 5:
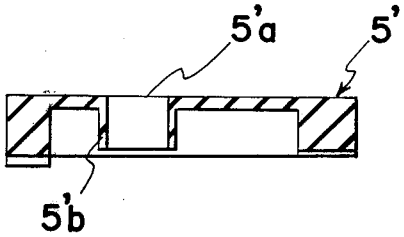
Figure 6:
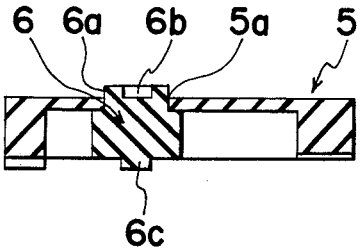
Figure 7:
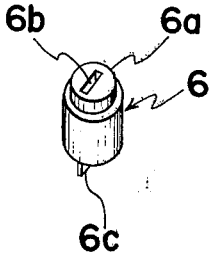
Figure 8:
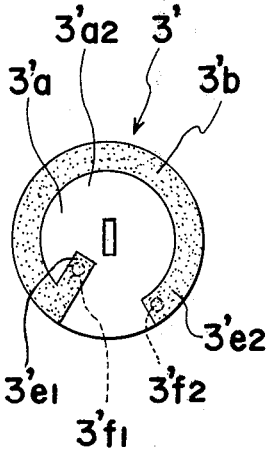
Figure 9:
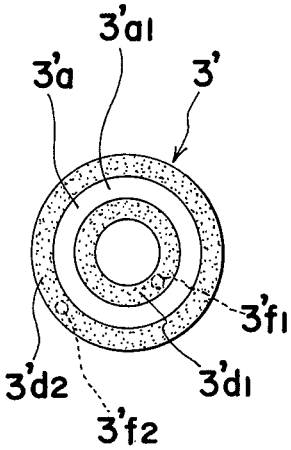
Figure 10:
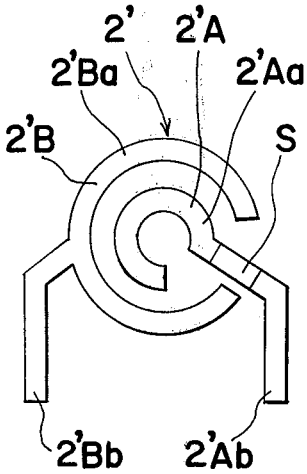

These and other objects and features of the present invention will become apparent from the following description taken in conjunction with the preferred embodiment thereof with reference to the attached drawings in which;

FIG. 1 is an exploded perspective view showing the construction of a variable resistor according to one embodiment of the present invention;

FIG. 2 is a perspective view of the variable resistor of FIG. 1 in an assembled state, FIG. 3 is a longitudinal sectional view of the variable resistor of FIG. 2, FIG. 4 is a longitudinal sectional view of a cover plate which can be applied to the variable resistor of FIG. 1, FIG. 5 is a view similar to FIG. 4, but particularly shows a modification thereof, FIG. 6 is a view similar to FIG. 4, but particularly shows a further modification thereof, FIG. 7 is a perspective view of an adapter used with the cover plate of FIG. 6;

FIGS. 8 and 9 show a modification of a rotor member employed in the variable resistor of FIG. 1, and FIG. 10 shows a modification of a lower stator terminal employed in the variable resistor of FIG. 1.

Before the description of the present invention proceeds, it is to be noted that like parts are designated by like reference numerals throughout several views of the accompanying drawings.

Referring now to FIGS. 1 to 3, there is shown a variable resistor R according to one preferred embodiment of the present invention which generally comprises a base plate or substrate 1 of electrically insulating material, for example, thermoplastic resin, a lower stator terminal 2 having a main terminal portion or a slightly curved resilient spring portion 2*a* of approximately U-shape fitted into a circular recess 1*a* formed in the base plate 1 and a stepped terminal end portion 2*b* integrally formed with and laterally extending from the portion 2*a*, a rotor member 3 of disc-like configuration also fitted into the recess 1*a* with one surface 3*a*1 thereof disposed on the resilient spring portion 2*a* of the lower stator terminal 2, and an upper stator terminal 4 having a main terminal portion or a curved resilient spring portion 4*a* of approximately O-shape which contacts the other surface 3*a*2 of the disc member 3 to slidably hold said rotor disc member 3 between the lower stator terminal 2 and the upper stator terminal 4 and also a stepped terminal end portion 4*b* integrally formed with and laterally extending from the main terminal portion 4*a*.

The base plate 1 having an octagonal shape is provided, in its one surface, with the circular recess 1*a* formed at approximately the central portion thereof, a groove 1*b* formed therein to connect the recess 1*a* and one side edge 1*c* of the base plate 1 for receiving therein an intermediate portion 2*c* of the stepped terminal end portion 2*b* of the lower stator terminal 2, a projection 1*d* extending laterally from the outer periphery of the circular recess 1*a* in a direction parallel to the groove 1*b* and toward the center of the recess 1*a*, and another projection 1*e* of trapezoidal shape extending upwardly from the one surface of the base plate 1 in a position adjacent to the other side edge 1*f* of the plate 1. The rotor member 3 includes an electrically insulating base plate 3*a*, for example, of ceramic material having a circular electrically resistant film layer 3*b* of approximately C-shape formed on the surface 3*a*2 thereof adjacent to the outer periphery thereof, a groove 3*c* formed in the central portion of the surface 3*a*2 to receive, for example, a tip of a screw driver (not shown) for rotation of the member 3, and an electrically conductive film layer 3*d*, for example, of calcined silver formed over the entire other surface 3*a*1 of the member 3, the resistant film layer 3*b* and the conductive film layer 3*d* being electrically connected to each other at one end 3*e* of the film layer 3*b*, for example, by a conductor member 3*f* extending through the member 3 thereat. The resilient spring portion 4*a* of the upper stator terminal 4 is provided with a contact point 4*d* at the forward under surface thereof for sliding contact under pressure with the resistant film layer 3*b* of the rotor member 3, an opening 4*c* formed at a portion thereof adjacent to the terminal end 4*b* having a shape complementary to the projection 1*e* of the base plate 1, and a pair of side plates 4*e* extending downwardly from opposite side edges of the portion 4*a* adjacent to the opening 4*c* for holding corresponding side edges of the base plate 1 therebetween when the upper terminal member 4 is fitted over the base plate 1.

For assembling the variable resistor R, the resilient spring portion 2*a* of the lower stator terminal 2 is first placed in the circular recess 1*a* of the base plate 1 with the intermediate portion 2*c* of the terminal end 2*b* accommodated in the groove 1*b* of the plate 1. Subsequently, the rotor member 3 is fitted into the circular recess 1*a* in such a manner that the conductive film layer 3*d* of the member 3 contacts the spring portion 2*a* of the lower stator terminal 2, with the member 3 being located under the projection 1*d* of the recess 1*a* and thereafter, the upper stator terminal 4 is fitted over the base plate 1 in such a manner that the trapezoidal projection 1*e* of the plate 1 extends through the corresponding opening 4*c* of the terminal 4 and the contact point 4*d* of the spring portion 4*a* contacts under pressure the resistant film layer 3*b* of the rotor member 3, while the side plates 4*e* of the terminal 4 hold the corresponding side edges of the base plate 1 positively. Accordingly, the lower stator terminal 2 and the rotor member 3 thus housed within the circular recess 1*a* of the base plate 1 are resiliently held therein at the contact point 4*d* of the spring portion 4*a* and the projection 1*d* of the recess 1*a*.

It should be noted here that the configurations of the base plate 1, the projection 1*e* and the corresponding opening 4*c*, the resilient spring portion 2*a* of the lower stator terminal 2, and the resilient spring portion 4*a* of the upper stator terminal 4, and the resistant film layer 3*b* and conductive film layer 3*d* of the rotor member 3 are not limited to those described with reference to the above embodiment, but may be modified to any other suitable shapes which perform the same function. For example, the projection 1*e* and the corresponding opening 4*c* may be replaced by a pair of spaced pin-like projections (not shown) extending upwardly from the base plate 1 and a corresponding pair of openings (not shown) formed in the upper stator terminal 4, so that after insertion of the pin-like projections into the corresponding openings, the ends of such projections extending through the openings can be staked or caulked thereat by heating.

Referring to FIGS. 4 to 6, the variable resistor R of FIGS. 1 to 3 may further be provided with a cover plate member 5 of box-like configuration as shown in FIG. 4, which is provided with an opening 5*a* formed in the upper surface thereof in a position corresponding to that of the groove 3*c* in the rotor member 3 for insertion, for example, of a screw driver therethrough to rotate the same member 3 for resistance adjustments. Such a cover plate member should preferably be bonded to the base plate 1 by thermal adhesion or the like. Provision of the cover plate member 5 of the above described type is particularly effective for preventing entrance of dust and dirt and also for protection of the internal structure of the variable resistor R. For the improvement of the effect of preventing ingress of dust and dirt, a modified cover plate member 5′ having a cylindrical member 5′*b* extending from the opening 5′*a* may be employed as shown in FIG. 5 so that the lower end of the cylindrical member 5′*b* contacts the surface 3*a*2 of the rotor member 3. Alternatively, as shown in FIG. 6 the cover plate member 5 of FIG. 4 may further be provided with an adaptor or plug member 6 (FIG. 7) having an upper portion 6*a* of reduced diameter which is rotatably fitted into the opening 5*a* and which is formed with a groove 6*b* at the central portion of its upper surface for receiving, for example, the tip of a screw driver (not shown) therein, and a projection 6*c* extending downwardly from the under surface of the plug member 6 for engagement with the groove 3*c* of the rotor member 3. The upper portion 6*a* of the plug member 6 may further be elongated to project from the opening 5*a* so as to serve as a knob (not shown) for the rotation of the member 6.

Although the variable resistor of the invention is mainly described with reference to the two terminal type variable resistor in the foregoing embodiment, it is to be noted that the present invention is not limited in its application to a two terminal variable resistor alone, but is readily applicable to variable resistors of other types, for example, to a three terminal type variable resistor as described hereinbelow with reference to the modification of FIGS. 8 to 10.

Referring now to FIGS. 8 to 10, there is shown a construction of a three terminal type variable resistor which is a modification of the variable resistor of FIGS. 1 to 3. Since the modification is mainly related to the structure of the rotor member 3 and the lower stator terminal 2 with the other parts of the variable resistor being generally similar to those of FIGS. 1 to 3, the description given hereinbelow is limited to the modified rotor member 3′ and lower stator terminal 2′ for brevity.

In the modified rotor member 3′, the C-shaped resistant film layer 3′*b* formed on the surface 3′*a*2 of the base plate 3′*a* of the member 3′ adjacent to the outer periphery of the plate 3′*a* has one end 3′*e*1 extended to a certain extent toward the center of the base plate 3′*a*, while the conductive film layer 3*d* described as formed over the entire surface 3*a*1 of the base plate 3*a* of FIGS. 1 to 3 is replaced by inner and outer ring-shaped conductive film layers 3′*d*1 and 3′*d*2 concentrically formed on the surface 3'a1 of the base plate 3'a. The extended end 3'e1 of the resistant film layer 3'b, the film layer 3'b is electrically connected with the inner conductive film layer 3'd1, for example, by a conductive member 3'f1 extending through the rotor member 3', while at the other end 3'e2 of the resistant film layer 3'b, the film 3'b is also connected with the outer conductive film layer 3'd2, for example, by a conductive member 3'f2 extending through the member 3'. Meanwhile, the lower stator terminal 2 described as employed in the variable resistor of FIGS. 1 to 3 is replaced by a lower stator terminal 2' as shown in FIG. 10 including split-ring-like inner and outer metal plates 2'A and 2'B which are spaced from each other and which are respectively in contact, at C-shaped main portions 2'Aa and 2'Ba thereof, with the inner and outer conductive films 3'd1 and 3'd2. The inner and outer metal plates 2'A and 2'B respectively have terminal ends 2'Ab and 2'Bb extending outwardly from the main portions 2'Aa and 2'Ba thereof for external electrical connections. The base plate 1 of FIGS. 1 to 3 may be slightly modified to receive such terminal ends 2'Ab and 2'Bb therein, e.g., the groove 1b described as formed in the base plate 1 of FIGS. 1 to 3 may be replaced by two grooves (not shown) formed in the plate 1 in positions corresponding to the terminal ends 2'Ab and 2'Bb of the lower stator terminal 2' of FIG. 10, and the outer conductive film layer 3'd2 of the rotor member 3' should be so arranged as not to contact the terminal end 2'ab of the metal plate 2'A when the rotor member 3' is placed on the lower stator terminal 2' housed in the circular recess 1a, for example by bending a portion S of the terminal end 2'Ab located between the opposite ends of the outer metal plate 2'B into a U-shape away from the path of the outer conductive film layer 3'd2.

It is to be noted here that the cover plate member 5 of FIGS. 4 to 8 mainly described with reference to the embodiment of FIGS. 1 to 3 may also be used with the modified three terminal variable resistor of FIGS. 8 to 10.

It should also be noted that the restriction of the rotational angle of the rotor member 3 or 3' may be effected by any known arrangements.

As is clear from the foregoing description, the variable resistor according to the present invention includes a base plate, at least one lower stator terminal, a rotor member, and an upper stator terminal, and the lower stator terminal is incorporated in one surface of the base plate, with the rotor member being rotatably mounted on the lower stator terminal. The rotor member has, on its one surface, an approximately C-shaped resistant film layer which slidingly contacts the upper stator terminal secured to the base plate, and is provided, on its other surface, with a conductive film layer which slidingly contacts the lower stator terminal, while the resistant film layer is connected for conduction, at least at its one end, with the conductive film layer.

The arrangement of the invention as described above has various advantages over the conventional arrangements as follows.

(i) Since the arrangement makes it possible to reduce the size of the variable resistor to a large extent, the variable resistor of the present invention is readily applicable to electrical and electronic equipment and devices requiring miniature-sized variable resistors, for example, electronic watches, cameras, hearing aids, transceivers and the like, thus contributing greatly to miniaturization of such equipment and devices.

(ii) Due to the fact that the slider, i.e. the stator terminal, is fixed to the base plate in the variable resistor of the present invention, the span of the slider can advantageously be made much longer than in the conventional arrangements, and thus, reliability in close contact between the slider contact and the resistant film layer has been improved to a large extent as compared with that in the conventional variable resistors.

(iii) Since the rotor member having the resistant film layer is arranged to be rotatable in the variable resistor of the present invention, the groove for receiving, for example, the tip of a screw driver can be formed in the rotor member, which arrangement is very convenient for users.

(iv) Since the variable resistor of the present invention requires no soldering, efficiency in the manufacturing thereof is appreciably improved, with less rate of faulty products and consequent high reliability.

(v) Simplified assembling of the few parts involved in the variable resistor of the present invention makes it possible to introduce an automatic assembling system, thus contributing much to reduction of cost.

(vi) With the construction of the variable resistor of the present invention, it is possible to provide a range of varying resistance through an angle of close to 360° as compared with that in the vicinity of 310° in the conventional variable resistors.

In the foregoing embodiment, the present invention is mainly described with reference to a variable resistor of extremely small size, but it should be noted that the concept of the present invention is not limited in its application to such a small sized variable resistor alone, but may readily be employed for large or medium sized variable resistors as well, depending on necessity.

Although the present invention has been fully described by way of example with reference to the attached drawings, it is to be noted that various changes and modifications will be apparent to those skilled in the art. Therefore, unless otherwise such changes and modifications depart from the scope of the present invention, they should be construed as being included therein.

What is claimed is:

1. A variable resistor for use in electrical and electronic equipment which comprises a base plate member of electrically insulating material, at least one first stator terminal member incorporated in one surface of said base plate member, a rotor member of electrically insulating material having electrically conductive film means on one surface thereof and electrically resistant film means on the other surface thereof, said rotor member being rotatably disposed on said first stator terminal member with said conductive film means contacting said first stator terminal member for sliding movement thereon, a second stator terminal member secured to said base plate member for sliding contact with said resistant film means of said rotor member, said resistant film means of said rotor member being electrically connected with said conductive film means of said rotor member.

2. A variable resistor as claimed in claim 1, wherein said base plate member is further provided at said one surface thereof with a recess means holding therein said first stator terminal member.

3. A variable resistor as claimed in claim 2, wherein said base plate member has a first projection means projecting into said recess for holding said rotor member and said first stator terminal member within said recess.

4. A variable resistor as claimed in claim 1, wherein said base plate member is further provided with a groove for receiving therein a terminal end of said first stator terminal member.

5. A variable resistor as claimed in claim 1, wherein said base plate member is further provided with second projection means for fixing said second stator terminal member to said base plate member.

6. A variable resistor as claimed in claim 1, wherein said first stator terminal member is a metal plate having a main terminal portion and a terminal end extending outwardly therefrom.

7. A variable resistor as claimed in claim 1, wherein said first stator terminal member is two metal plates respectively having main terminal portions which are arranged in spaced relation to each other, with a terminal end extending outwardly from each of said two metal plates for electrical connection.

8. A variable resistor as claimed in claim 1, wherein said rotor member is provided, for rotation thereof, with groove means for engagement by adjusting means.

9. A variable resistor as claimed in claim 1, wherein said resistant film means of said rotor member is a circular resistant film layer having an interruption therein to provide opposite ends thereof and positioned adjacent the outer periphery of said rotor member for sliding contact with said second stator terminal member.

10. A variable resistor as claimed in claim 9, further comprising an electrically conductive member extending through said rotor member from one of the opposite ends of such resistant film layer to said conductive film means for electrically connecting said resistant film layer and said conductive film means.

11. A variable resistor as claimed in claim 10, wherein said circular resistant film layer has said one end of said opposite ends extended toward center of said rotor member.

12. A variable resistor as claimed in claim 1, wherein said conductive film means on said rotor member is a conductive film layer covering all of said one surface of said rotor member for sliding contact with said first stator terminal member.

13. A variable resistor as claimed in claim 1, wherein said conductive film means on said rotor member is two annular conductive film layers concentrically formed on said one surface of said rotor member for sliding contact with said first stator terminal member.

14. A variable resistor as claimed in claim 1, wherein said second stator terminal member is a metal plate having a resilient main terminal portion and a terminal end extending outwardly therefrom, said resilient main terminal portion contacting said resistant film means of said rotor member under pressure.

15. A variable resistor as claimed in claim 14, wherein said base member has a second projection means thereon and said resilient main terminal portion of said second stator terminal member has an opening for receiving said second projection means on said base plate member.

16. A variable resistor as claimed in claim 13, wherein said resistant film layer has opposite ends, and electrically conductive members between said two annular conductive film layers and said opposite ends of said resistant film layer on the other side of said rotor member.

17. A variable resistor as claimed in claim 1, further including a cover plate member which fits over said base plate member.

18. A variable resistor as claimed in claim 17 in which said rotor member is further provided with a groove means for engagement by an adjusting means, and said cover plate member having an opening in a position corresponding to said groove means for permitting insertion of the adjusting means therethrough.

19. A variable resistor as claimed in claim 18 wherein said cover plate member further has a sleeve member integral with said cover plate member and extending from said opening toward a position adjacent to said groove means of said rotor member.

20. A variable resistor as claimed in claim 17, in which said rotor member is further provided with a groove means for engagement by an adjusting means, and said cover plate member further having an opening in a position corresponding to said groove means, and a plug member rotatably fitted into said opening, said plug member having a groove at one end surface extending through said opening and also having a projection on the other end surface which fits into said groove means of said rotor member.

* * * * *